US010125450B2

(12) United States Patent
Riad

(10) Patent No.: US 10,125,450 B2
(45) Date of Patent: Nov. 13, 2018

(54) ARTICLE SORTING METHOD

(71) Applicant: Andrew N. Riad, Raleigh, NC (US)

(72) Inventor: Andrew N. Riad, Raleigh, NC (US)

(73) Assignee: CREATESMART LLC, Cary, NC (US)

( * ) Notice: Subject to any disclaimer, the term of this patent is extended or adjusted under 35 U.S.C. 154(b) by 0 days.

(21) Appl. No.: 15/838,246

(22) Filed: Dec. 11, 2017

(65) Prior Publication Data

US 2018/0100264 A1 Apr. 12, 2018

Related U.S. Application Data

(63) Continuation of application No. 13/708,891, filed on Dec. 7, 2012, which is a continuation-in-part of application No. 13/180,682, filed on Jul. 12, 2011, now Pat. No. 8,689,974.

(51) Int. Cl.

| | |
|---|---|
| ***D06F 89/02*** | (2006.01) |
| ***B65D 85/18*** | (2006.01) |
| ***D06F 93/00*** | (2006.01) |
| ***D06F 95/00*** | (2006.01) |

(52) U.S. Cl.

CPC ..... *D06F 89/02* (2013.01); *B65D 85/18* (2013.01); *D06F 93/00* (2013.01); *D06F 95/002* (2013.01)

(58) Field of Classification Search

CPC ..... Y10S 24/29; Y10S 209/928; B65D 85/18; A47G 25/54; A45C 13/03; A41B 11/002

USPC ..... 222/481.5, 482, 460; 229/400; 232/1 B; 221/309; 206/278, 282, 283, 292, 284, 206/423, 493, 937; 141/286; 220/584, 220/601, 720, 729, 785, 786, 86.1, 86.3, 220/908.3, 909

See application file for complete search history.

(56) References Cited

U.S. PATENT DOCUMENTS

| | | | | |
|---|---|---|---|---|
| 3,252,567 A * | 5/1966 | Baron | ..... | B65D 57/00 206/278 |
| 3,972,094 A | 8/1976 | Fuller | | |
| 4,921,147 A | 5/1990 | Poirier | | |

OTHER PUBLICATIONS

CIPO, Office Action for Canadian Patent Application No. 2,857,600, dated Jun. 18, 2018.

* cited by examiner

*Primary Examiner* — Andrew T Kirsch
*Assistant Examiner* — Kevin Castillo
(74) *Attorney, Agent, or Firm* — NK Patent Law

(57) ABSTRACT

A method for matching pairs of socks includes engaging a first sock with a channel defined within a sock engaging assembly. The sock engaging assembly is defined about a basket. The method including inserting a second sock into the first sock and pushing the matched pair of socks through the channel into the basket.

8 Claims, 9 Drawing Sheets

ARTICLE SORTING METHOD

CROSS-REFERENCE TO RELATED APPLICATIONS

This application is a continuation of U.S. patent application Ser. No. 13/708,891 filed on Dec. 7, 2012 which is a continuation-in-part of U.S. patent application Ser. No. 13/180,682 filed on Jul. 12, 2011, the entire contents of which are hereby incorporated by reference.

TECHNICAL FIELD

The subject matter disclosed herein is directed towards an article sorting apparatus, and more particularly, towards an article sorting and matching apparatus for matching articles of clothing such as socks.

BACKGROUND

Sorting articles such as garments and other clothing is a tedious and time consuming process. For example, sorting socks requires that a person sorts each individual sock while looking for a match to that sock. In order to find matches, the person may lay all of the socks on a nearby structure such as a table or floor, and then individually select matching pairs of socks. The matched pair of socks are then typically placed into a laundry basket and stored in an appropriate place.

Apparatuses have been developed to aid in sorting and matching garments such as socks. For example, apparatuses have been developed that compare the size and colors of articles of clothing such as socks in order to sort and match the socks. These apparatuses are expensive and impractical for most users. Additionally, various improvements to garments have been developed to help aid in sorting and matching garments such as socks. For example, some garments have print indicia at a predetermined location on the garment for matching garments. The print indicia for each garment is then compared with each other garment's print indicia to find a match. This system detracts from the aesthetic qualities of the garments.

Accordingly, a need exists for an apparatus or device that addresses the problems associated with conventional apparatus and methods for sorting garments.

SUMMARY

This Summary is provided to introduce a selection of concepts in a simplified form that are further described below in the Detailed Description of Illustrative Embodiments. This Summary is not intended to identify key features or essential features of the claimed subject matter, nor is it intended to be used to limit the scope of the claimed subject matter.

Disclosed herein is a sock sorting apparatus. The apparatus includes a basket for containing socks, and a sock engaging assembly carried by the basket. The sock engaging assembly includes a channel through which a first sock is engaged at a periphery thereof, and a second sock is inserted into engagement with the first sock and ingressed through the channel into the basket.

According to one or more embodiments, the channel defines a taper, with a small end of the taper facing outwardly from the basket.

According to one or more embodiments, the channel defines an expansion slot for accommodating different size socks.

According to one or more embodiments, the sock engaging assembly is selectively carried by the basket.

According to one or more embodiments, the sock engaging assembly is selectively carried by a detent extending from the channel and being received within an opening defined in the panel.

According to one or more embodiments, the apparatus includes a panel translatable about the basket and that receives the sock engaging assembly.

According to one or more embodiments, the panel receives a plurality of sock engaging assemblies.

According to one or more embodiments, the end of the channel facing inwardly towards the basket defines a cutout portion for being flush with an inner facing surface of the panel.

According to one or more embodiments, a sock engaging assembly for assisting in the folding and matching of socks is provided. The sock engaging assembly includes a channel through which a first sock is engaged at a first end thereof, and a second sock is inserted into engagement with the first sock and ingressed through the second end of the channel.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed invention is not limited to the specific methods and instrumentalities disclosed. In the drawings.

DETAILED DESCRIPTION

The presently disclosed invention is described with specificity to meet statutory requirements. However, the description itself is not intended to limit the scope of this patent. Rather, the inventors have contemplated that the claimed invention might also be embodied in other ways, to include different steps or elements similar to the ones described in this document, in conjunction with other present or future technologies.

Figure 1:
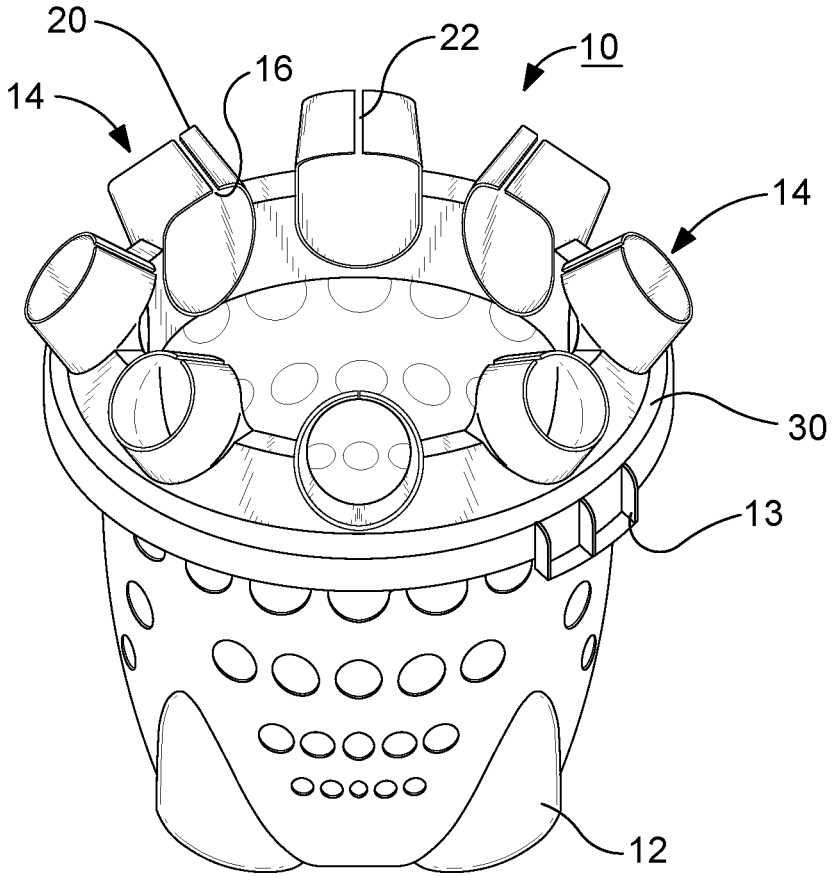
FIG. 1 is a front-facing perspective view of an article sorting apparatus according to one or more embodiments disclosed herein.

A sock sorting apparatus is illustrated in FIG. 1 and generally designated 10. The apparatus 10 includes a basket 12 for containing socks. The basket 12 may include one or more handles 13 for providing a support surface for a user to grab onto. The basket 12 is illustrated with a generally cylindrical shape, however, any appropriately configured shape, size, or layout may be employed. The apparatus 10 may further include a sock engaging assembly 14 that is carried by the basket 12. The sock engaging assembly 14 may be selectively carried by the basket 12 such that the assembly 14 can be removed from the basket 12, or alternatively, may be fixably secured to the basket 12.

The sock engaging assembly 14 may include a channel 20 through which a first sock is engaged at a periphery 22 thereof. The channel 20 is illustrated as being cylindrical or conical in nature, but any shape or structure to which a sock can be engaged to may be employed. The channel 20 may be made from a generally flexible material and may extend in a generally upward and outward direction relative to the basket 12 as illustrated in FIG. 1, or may extend in any other appropriately configured manner. In use, a second sock is inserted into engagement with the first sock and ingressed through the channel 20 into the basket 12.

The channel 20 may define a taper such that one end of the channel is larger than the other. As illustrated, the small end of the taper faces outwardly from the basket 12 and the large end of the taper faces inwardly into the basket. The channel 20 may define an expansion slot 22 for accommodating different size socks. The expansion slot 22 may be provided such that, for larger socks, the channel 20 spreads outwardly creating a larger cross-section for the channel 20 into which the pair of socks can be ingressed through.

Figure 2:
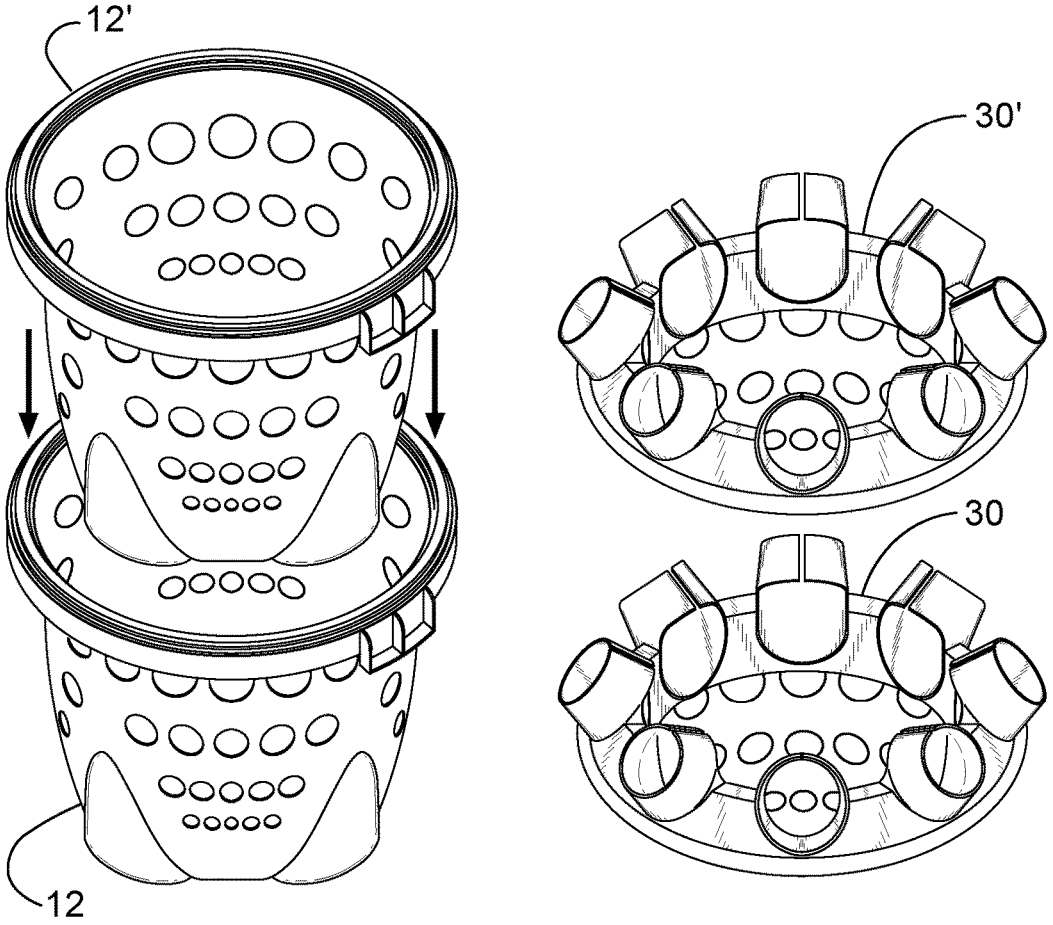
FIG. 2 is a front-facing perspective view of a pair of stacked article sorting apparatuses according to one or more embodiments disclosed herein.

The sock engaging assembly 14 may further include a panel 30. The panel 30 may be selectively or fixedly engaged with the basket 12. In one or more embodiments, the panel 30 may be translatable about the basket 12, such as, for example, via rotation. The panel 30 may be removable from the basket 12, such that successive baskets can be stacked onto one another into nestable engagement, such as that which is illustrated in FIG. 2 between baskets 12 and 12'. The panel 30 may be configured to receive a plurality of sock engaging assemblies 14.

Figure 3:
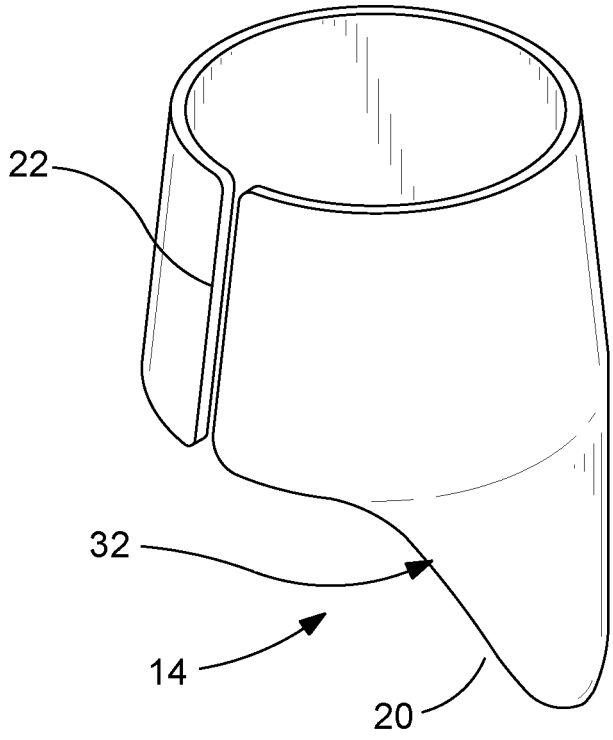
FIG. 3 is a perspective view of an article engaging apparatus according to one or more embodiments disclosed herein.

The channel 20 according to one or more embodiments is illustrated in FIG. 3. An end of the channel 20 facing inwardly towards the basket 12 defines a cutout portion 32 for being flush with an inner facing surface of the panel 20. In this manner, the channel 20 will not extend beyond the panel 30 into the basket 12, thereby providing unimpeded progress into the basket 12 of a matched pair of socks.

Figure 4:
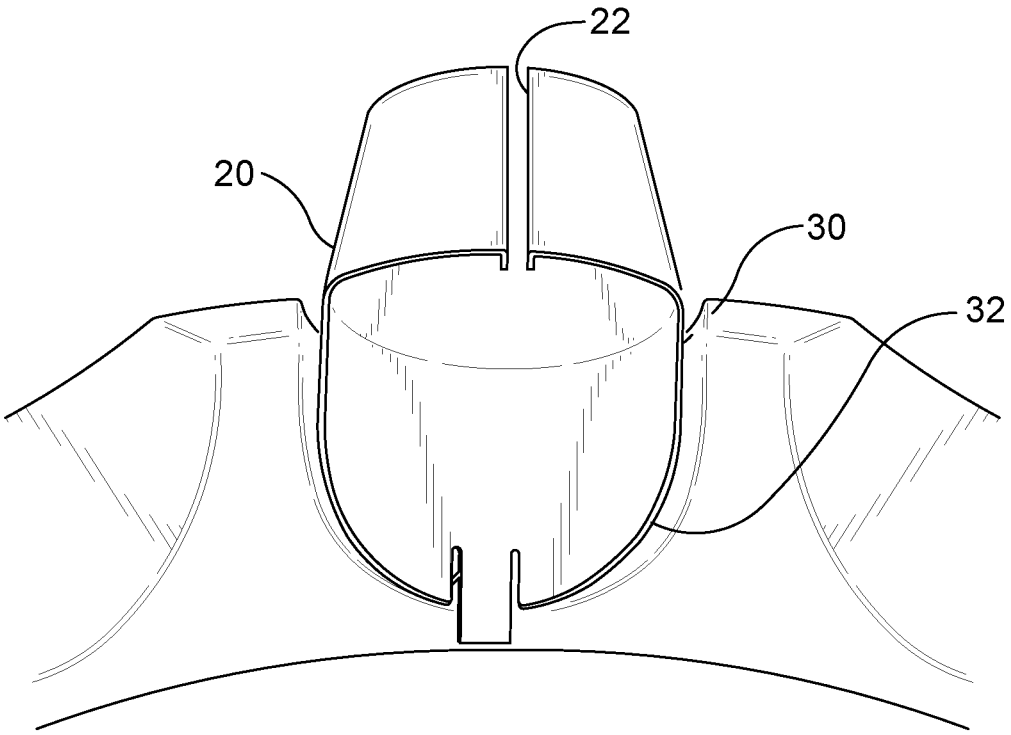
FIG. 4 is a perspective view of an article engaging apparatus according to one or more embodiments disclosed herein.

FIG. 4 illustrates one sock engaging assembly 14 installed about the panel 30. Each sock engaging assembly 14 is selectively engageable about a socket 34 formed in the panel 30. A plurality of sockets 34 may be provided, each configured for receiving a respective sock engaging assembly 14. In this manner, sock engaging assemblies 14 may be selected by a user in any number and spacing arrangement that is desired.

Figure 5:
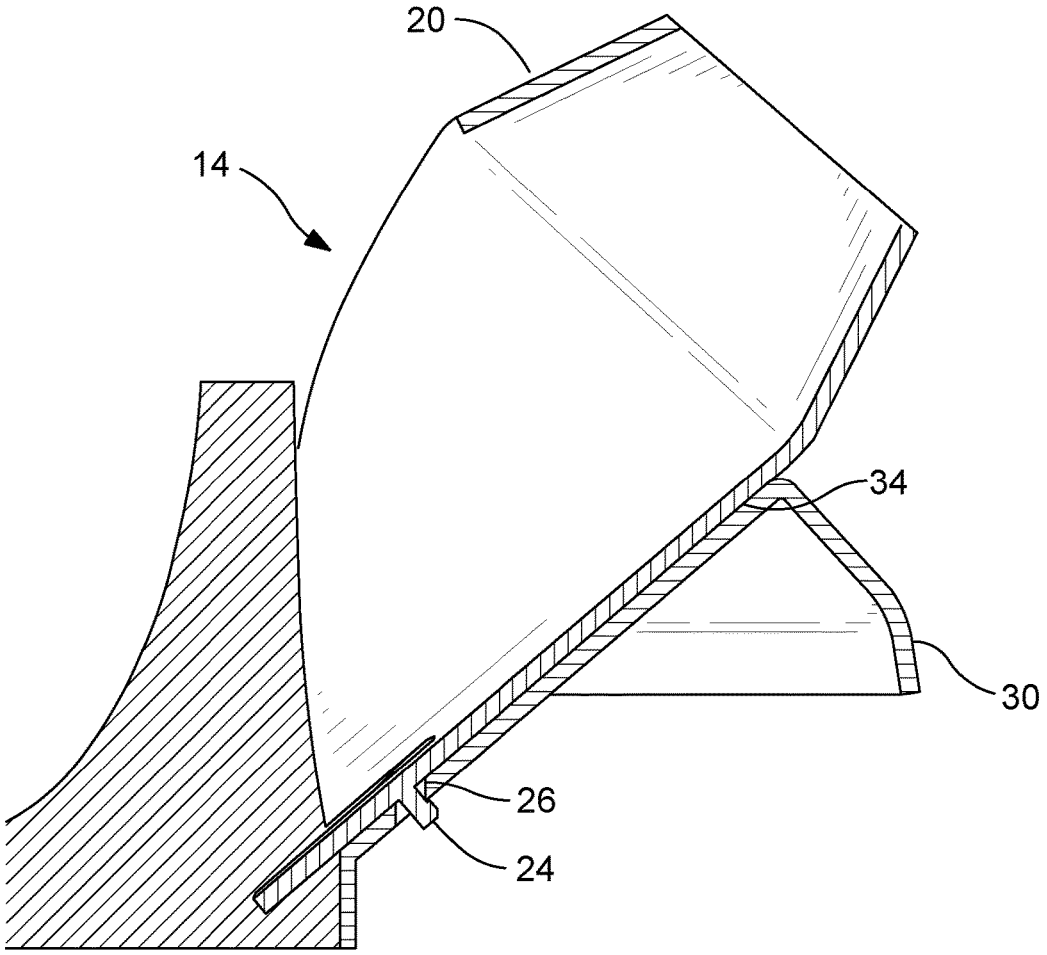
FIG. 5 is a side view of an article engaging apparatus according to one or more embodiments disclosed herein.

As illustrated in FIG. 5, one or more embodiments of a manner for selectively engaging the sock engaging assembly 14 with the panel 30 is provided. The sock engaging assembly 14 is selectively carried by a detent 24 extending from the channel 20 and being received within an opening 26 defined in the panel 30. The detent 24 may be flexible so that it can be bent into and out of engagement with the opening 26, thereby engaging the sock engaging assembly 14 with the panel 30.

Figure 6A:
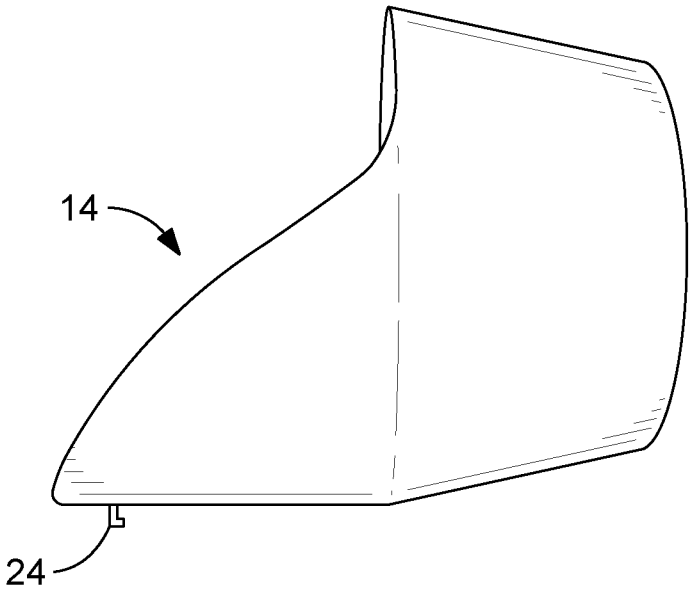
FIG. 6A and FIG. 6B illustrate respective article engaging apparatuses of varying sizes according to one or more embodiments disclosed herein.
Figure 6B:
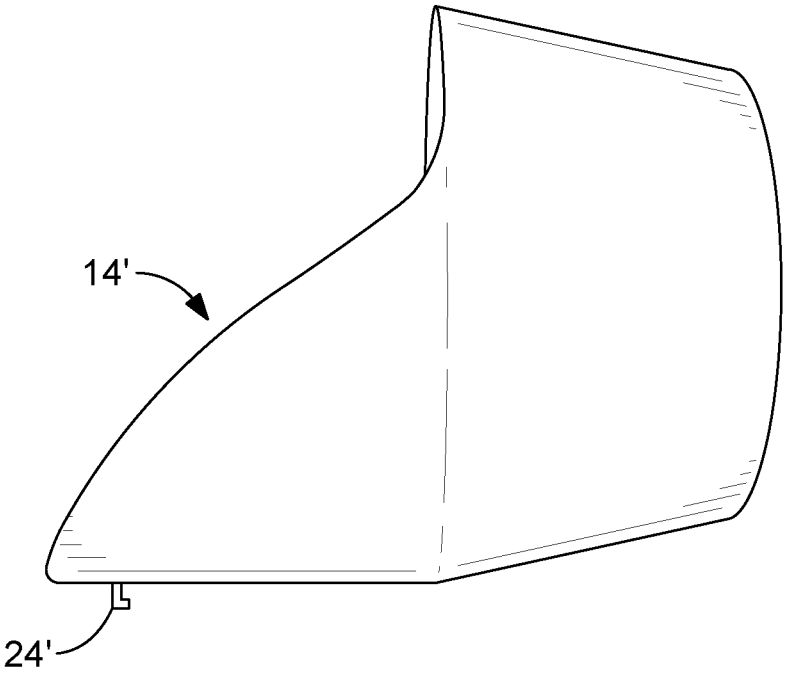

FIG. 6A and FIG. 6B illustrate sock engaging assemblies 14 and 14', respectively, that are of differing sizes. This allows for a different size sock engaging assembly to be installed about panel 30 to match the likely size of sock for which the apparatus 10 is being used for. Additionally, the user may install sock engaging assemblies of various sizes about apparatus 10 for accommodating various size socks.

Figure 7A:
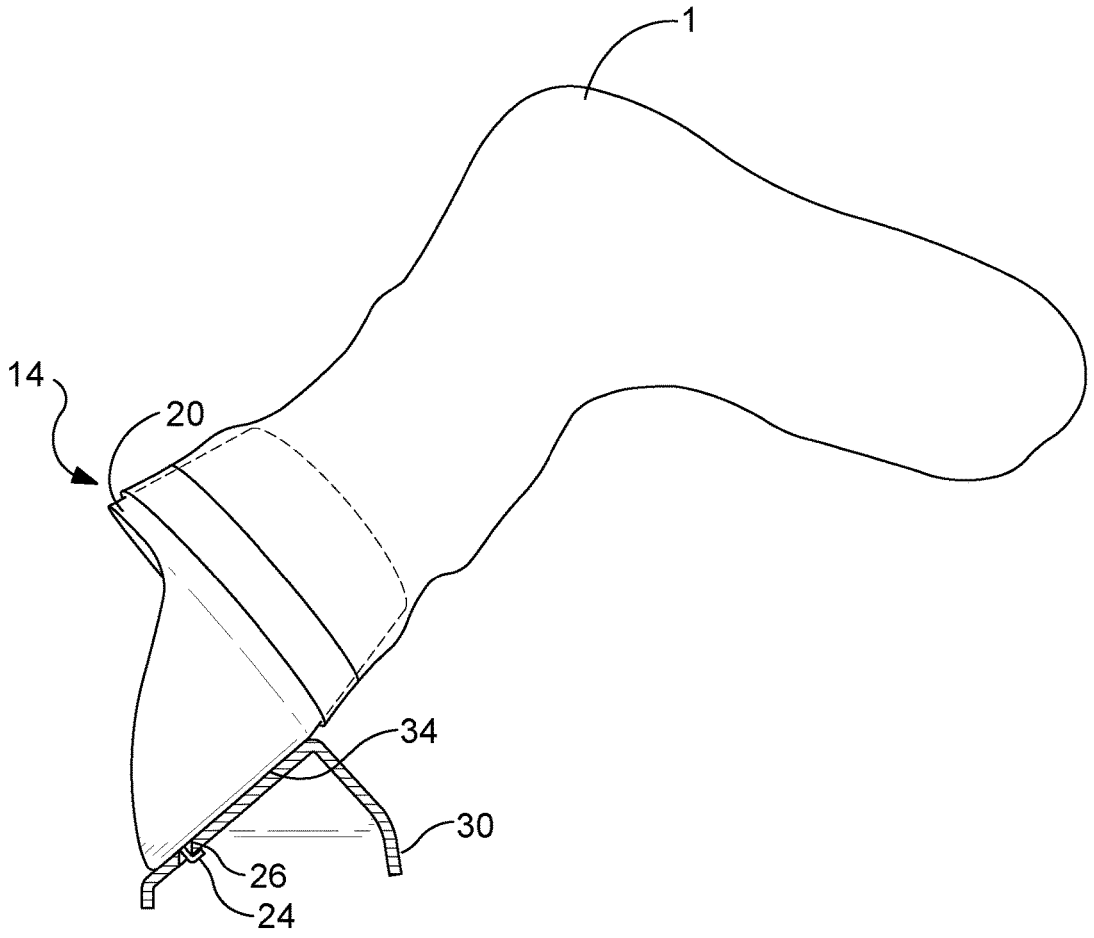
FIG. 7A, FIG. 7B, and FIG. 7C illustrate sequential operation of engagement of a sock about the article engaging apparatus according to one or more embodiments disclosed herein.

As illustrated in FIG. 7A, the open end of the sock 1 is expanded to have a footprint larger than that of the channel 20 and the open end of the sock 1 is then positioned over the channel 20. The open end of the sock 1 is then released and, due to the elastic construction of the sock 1, the open end returns to an un-expanded footprint and into engagement with the channel 20.

Figure 7B:
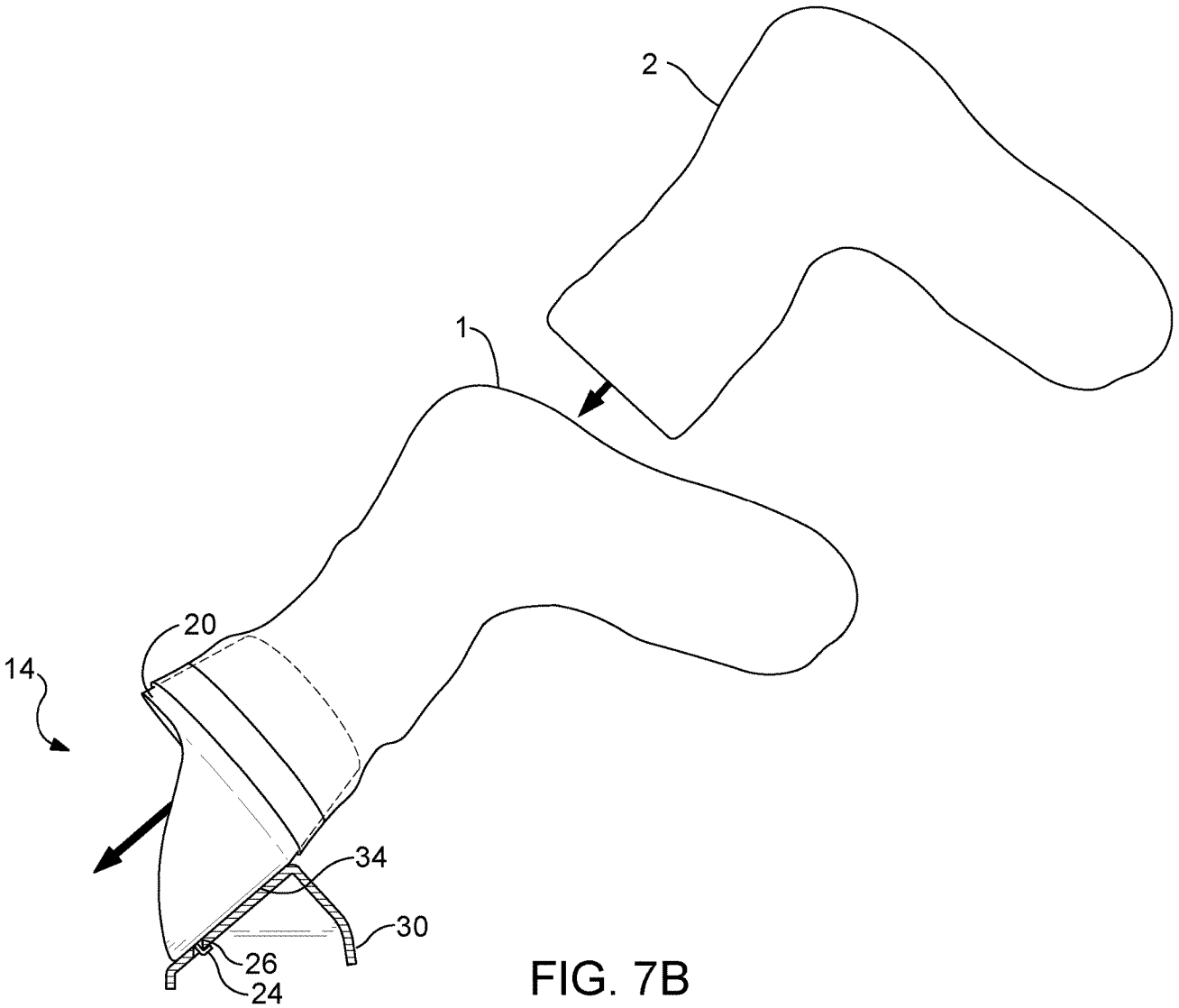
Figure 7C:
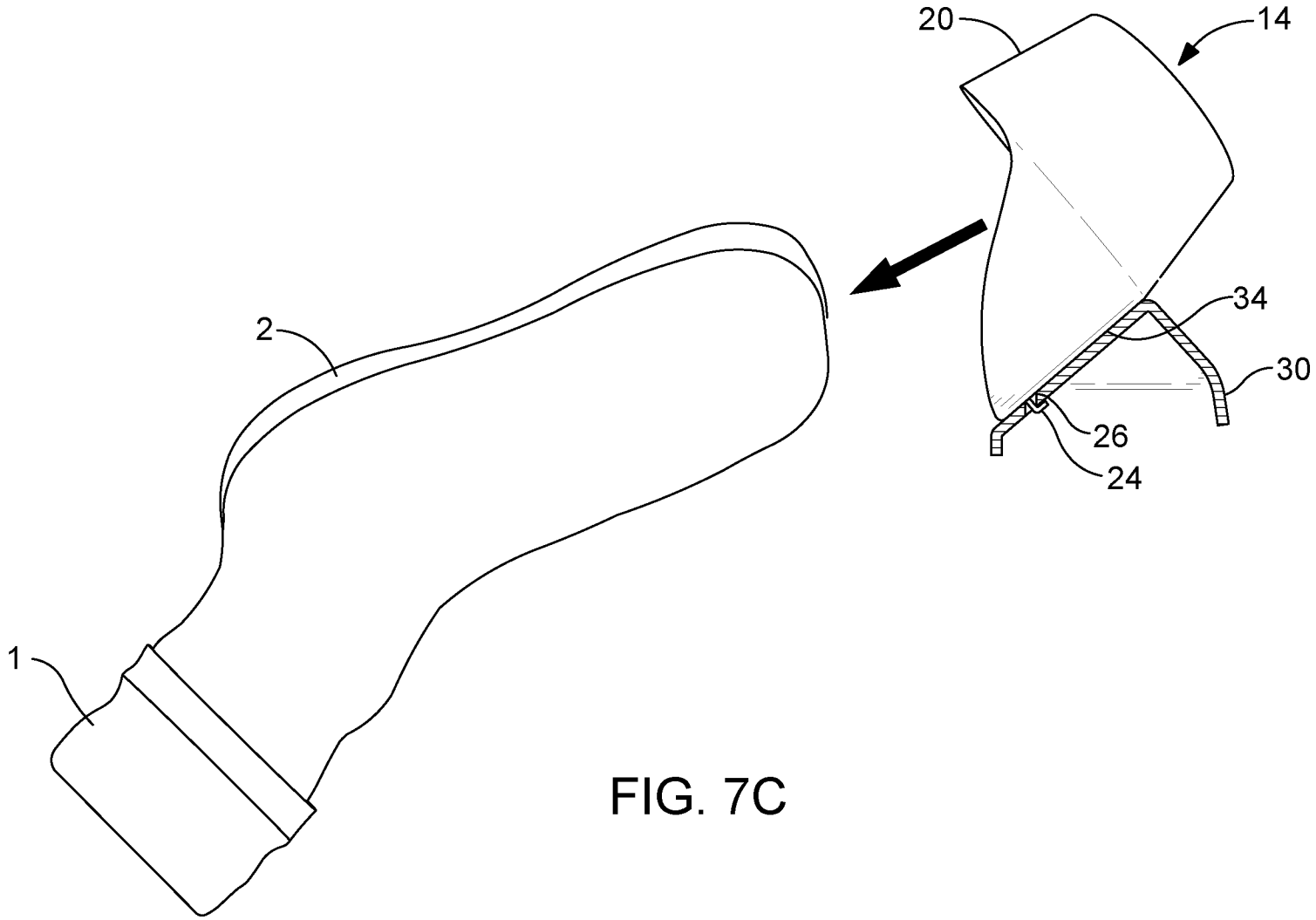

As illustrated in FIG. 7B, a second sock 2 is positioned proximal the first sock 1 and the matched pair of the first sock 1 and the second sock 2 are inserted into and through channel 22 and disposed into the basket 12 as illustrated in FIG. 7C. FIG. 7A, FIG. 7B, and FIG. 7C represent a successive step in using the apparatus 10 according to one or more embodiments illustrated herein. While a single first sock 1 is illustrated as being installed on one channel 20 in FIGS. 7A through 7C, the panel 20 may be configured to include a plurality channels 20. In this manner, each of a plurality of socks may be engaged with each of a plurality of channels 20. Accordingly, a user of the apparatus 10 can select a plurality of non-matching socks to each engage each channel 20. The remaining socks would then be matched to the matching sock in engagement with channel 20 according to the description in this and the prior paragraph.

While the embodiments have been described in connection with the preferred embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed:

1. A method for matching pairs of socks, the method comprising:

engaging a first sock with a channel defined within a sock engaging assembly, wherein the first sock is engaged by expanding the sock around a periphery of the channel such that an outer diameter of the expanded sock is greater than an outer diameter of the channel, the sock engaging assembly defined about a basket, wherein the basket has an upper end and an interior below the upper end, wherein the sock engaging assembly is carried by a panel mounted on the upper end of the basket and the panel includes multiple sock engaging assemblies;

inserting a second sock into an interior of the first sock and pushing the matched pair of socks through the channel into the basket.

2. The method according to claim 1, wherein the each channel defines a taper, with a small end of the taper facing outwardly from the basket.

3. The method according to claim 1, wherein each channel defines an expansion slot for accommodating different size socks having different diameters by expanding the channel to increase the diameter thereof by expanding a gap defined by the slot.

4. The method according to claim 1, wherein the sock engaging assembly is selectively carried by the basket.

5. The method according to claim 4, wherein the sock engaging assembly is selectively carried by a detent extending from the channel and being received within an opening defined in a panel.

6. The method according to claim 1, further comprising a panel translatable about the basket and that receives the sock engaging assembly.

7. The method according to claim 6, wherein the end of the channel facing inwardly towards the basket defines a cutout portion for being flush with an inner facing surface of the panel.

8. The method according to claim 1, further including engaging a third sock with another of the multiple sock engaging assemblies, and further including engaging a fourth sock into an interior of the third sock and pushing the matched pair of socks through a channel of the another of the multiple sock engaging assemblies into the basket.

* * * * *